US005253636A

United States Patent [19]

Glover et al.

[11] Patent Number: 5,253,636

[45] Date of Patent: Oct. 19, 1993

[54] APPARATUS AND METHOD FOR CONTROLLING GREASE BUILD-UP IN COOKING VENT DUCTS

[75] Inventors: Lewis H. Glover, Pasadena, Tex.; Gregory H. Glover, 3806 Cottonwood Dr., LaPorte, Tex. 77571

[73] Assignee: Gregory H. Glover, Pasadena, Tex.

[21] Appl. No.: 898,291

[22] Filed: Jun. 15, 1992

[51] Int. Cl.[5] ..... F24C 15/20

[52] U.S. Cl. ..... 126/299 R; 126/307 R; 454/44

[58] Field of Search ..... 126/301, 307 R, 299 R, 126/299 D; 454/44–47

[56] References Cited

U.S. PATENT DOCUMENTS

| | | | |
|---|---|---|---|
| 1,992,200 | 2/1935 | Ford . | |
| 2,082,413 | 6/1937 | Meuller et al. . | |
| 2,818,060 | 12/1957 | Field | 126/307 R |
| 2,842,163 | 7/1958 | Boylan . | |
| 2,921,606 | 1/1960 | McCauley . | |
| 2,971,532 | 2/1961 | McLaren et al. . | |
| 3,082,024 | 3/1963 | Boylan . | |
| 3,911,895 | 10/1975 | Van Schoyck | 126/299 D |
| 4,250,609 | 2/1981 | Beaudoin . | |
| 4,306,491 | 12/1981 | Reardon, Jr. . | |

*Primary Examiner*—Carroll B. Dority

*Attorney, Agent, or Firm*—Pravel, Hewitt, Kimball & Krieger

[57] ABSTRACT

Method and apparatus for controlling grease build-up in cooking vent ducts that includes installing a heat resistant close fitting custom built duct liner and periodically removing, cleaning, and replacing same.

9 Claims, 3 Drawing Sheets

FIG. 1C
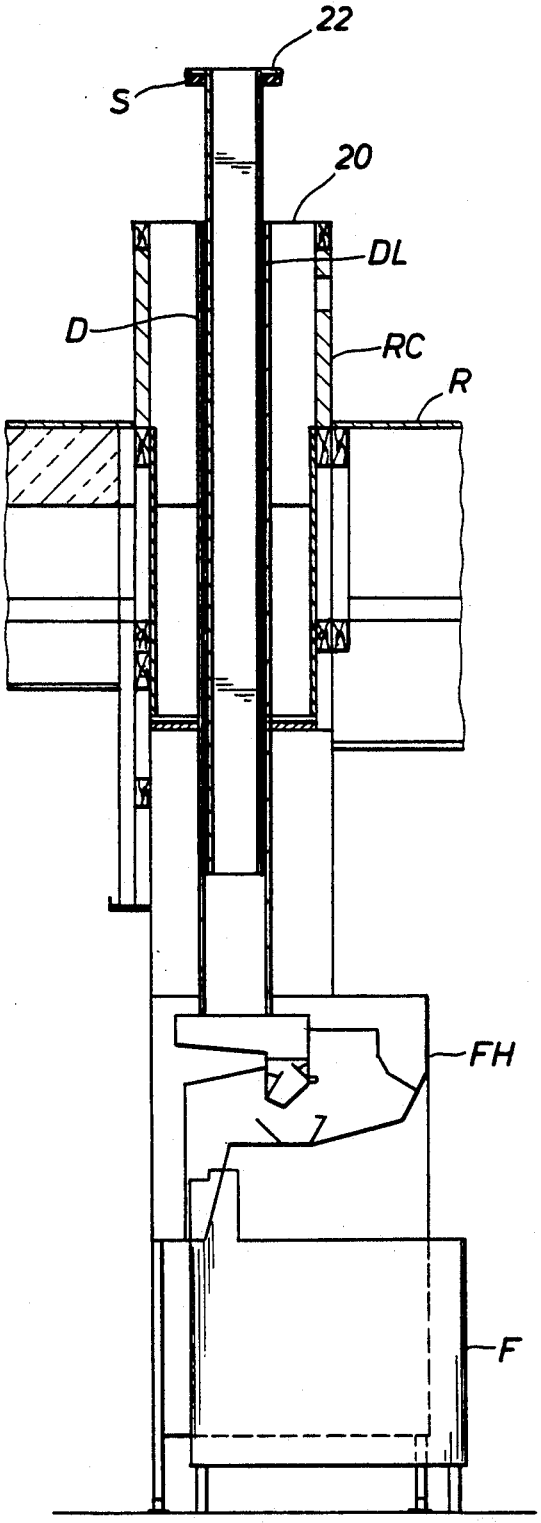
FIG. 2A
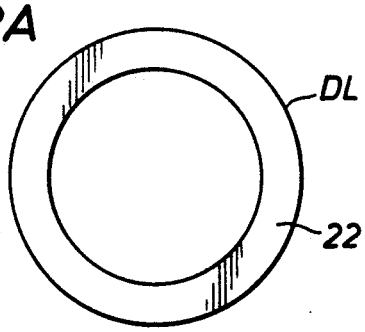
FIG. 2
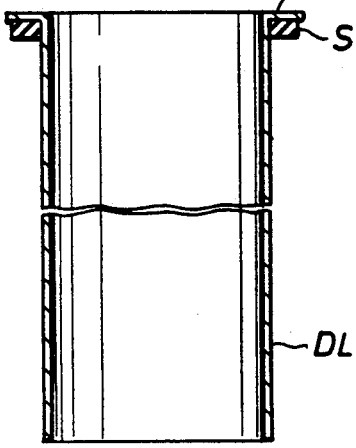
FIG. 3A
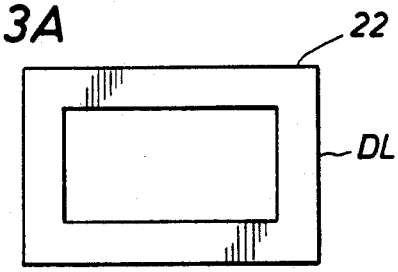
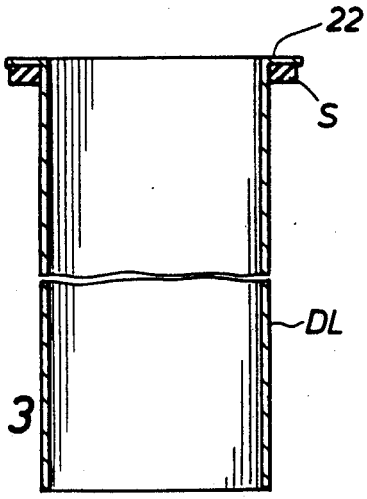
FIG. 3

APPARATUS AND METHOD FOR CONTROLLING GREASE BUILD-UP IN COOKING VENT DUCTS

FIELD OF THE INVENTION

The present invention relates to apparatus and method for controlling grease build-up in cooking vent ducts.

BACKGROUND OF THE INVENTION

One of the problems facing those maintaining cooking establishments, such as the restaurant and fast food businesses, is the accumulation of grease and oil in the ducts leading from the cooking vent hoods to the air exhaust on the roof. As the air is drawn from the cooking services up through this duct, it deposits grease and oil accumulations on the duct walls. Through time, this buildup becomes both a fire and a health hazard. Further, a percentage of these ducts will not be completely sealed, creating the risk that a portion of the gasses and grease escapes into the attic area creating hazards.

To address this problem, restaurants regularly have a contractor clean the ducts. The current procedure, which must be carried out after business hours, requires the contractor to first cover the kitchen area with plastic sheeting. A funnel of plastic is created to carry soap, water and grease into a container or directly into the floor drains. After protecting the kitchen area, the contractor moves to the roof where a hot water high pressure washer outlet is brought up. The fans are removed which exposes the duct. Generally, excess grease is scraped off the duct as far down as can be reached and is allowed to fall into the plastic in the kitchen area. The next step is to wash the ducts with the high pressure washer and soap. There is a limit to how far down into the duct this aspect of the cleaning procedure can actually reach. Normally a greasy residue is left, especially in the longer ducts. In ducts which are not completely sealed, this procedure can also force water, soap and grease into the attic area. After washing out the duct, the contractor replaces the fan.

In the process of cleaning, the contractor has moved around on the roof for a period in order to properly wash the duct and will generally soak the roof area with chemicals and water. It is reported that this area is the source for most roof leaks in these establishments.

The contractor lastly moves to the kitchen where there is a container of water, chemicals and grease for disposal. This has to be disposed of into the floor drain, grease trap or garbage container. At times leaks develop in the plastic which can cause the water, chemicals and grease to splatter on the cooking surfaces, floors and walls.

In summary, this is a very nasty and time consuming job. Existing procedures require hours of after-hour employee time. In fact, the existing procedures for maintaining ducts are sufficiently disagreeable that restaurant owners delay the process, collecting excessive grease in the ducts and creating a fire hazard, a health hazard and noxious odors. It is an object of the present invention to solve the above problems.

U.S. Pat. No. 4,306,491 to Beaudoin appreciates the above problems and proposes a solution. Beaudoin proposes utilizing a replaceable, expandable elongated metal foil duct liner bag. These bags have balloon walls and are expanded by air pressure, in theory, to seal against the duct. It has been found in practice, however, that these bags are impractical. They develop leaks, and thus do not protect the duct, and/or they become extremely difficult to remove.

SUMMARY AND OBJECTS OF THE INVENTION

The present invention offers an improved method and apparatus to solve the above recited problems. According to the preferred embodiment of the present invention, each duct is provided with two custom built liners. The liners are preformed to fit a given duct and are constructed of rigid (as opposed to collapsible) units of material sufficient to withstand duct temperatures of up to at least 350° F. For subsequent cleaning methods preferred, such as oven cleaning, being able to withstand higher temperatures up to around 750° F. would be desirable. Sheet metal offers an acceptable liner material.

The design of the liner is such that it fits closely, but not tightly, into the existing duct. The small annular space remaining between the liner and the duct is sealed. In one preferred embodiment this seal is at the top, or exhaust end, and is performed by a high temperature sealer. The seal does not allow air to raise in the annular area. Hence, the exhaust gasses pass through the inside of the liner and all accumulations of grease will be on the inside of the liner.

By design, the liner should decrease as little as possible the inside diameter of the effective duct area in order to maximize venting.

In operation, the duct maintenance contractor comes to the restaurant, removes the exhaust fan at the duct exhaust end, and installs one custom designed duct liner inside the duct from the roof to the vent hood. The maintenance contractor then returns periodically. A suggested schedule would be every two months. The exhaust fan is removed from the exhaust end of the duct on the roof. The greasy liner is removed. A similar clean second liner is installed in its place. The greasy liner is taken to a central location and cleaned and stored until the next recommended maintenance call.

Alternately, a single custom built greasy liner could be cleaned at the site, but not on the roof, using equipment the contractor brings on a truck, and then replaced.

The advantages of the present method and apparatus for maintaining cooking vent ducts are that it requires no set up time inside the kitchen, and eliminates the mess therein, reducing the chances of contamination normally associated with the present method of cleaning. The maintenance contractor is on location only minutes instead of hours. Access to the interior of the kitchen is not required. The presence of restaurant employees after hours is not required. The limited time the maintenance contractor is on the roof greatly reduces the chances of roof damages. No pressure washers or chemicals are used on the roof to clean the ducts, thereby reducing roof and kitchen damage. The painlessness of the procedure means that it will be performed more frequently, thereby greatly reducing the fire hazard and health hazards due to accumulation of grease. Furthermore, having a duct liner inside the duct effects a double wall that reduces the chance of heat, grease and gasses escaping into the attic, causing damage to the ceiling area.

BRIEF DESCRIPTION OF THE DRAWINGS

FIGS. 1A, 1B and 1C offer cross-sectional illustrations of a restaurant fryer, hood and duct system, without a duct liner, including a duct liner and with a duct liner in the removal or insertion stage.

FIGS. 2 and 3 offer an elevational view of a circular and a rectangular duct liner, respectively.

FIGS. 2A and 3A offer plan or top views of a circular and rectangular duct liner, respectively.

DETAILED DESCRIPTION OF THE PREFERRED EMBODIMENT

Figure 1A:
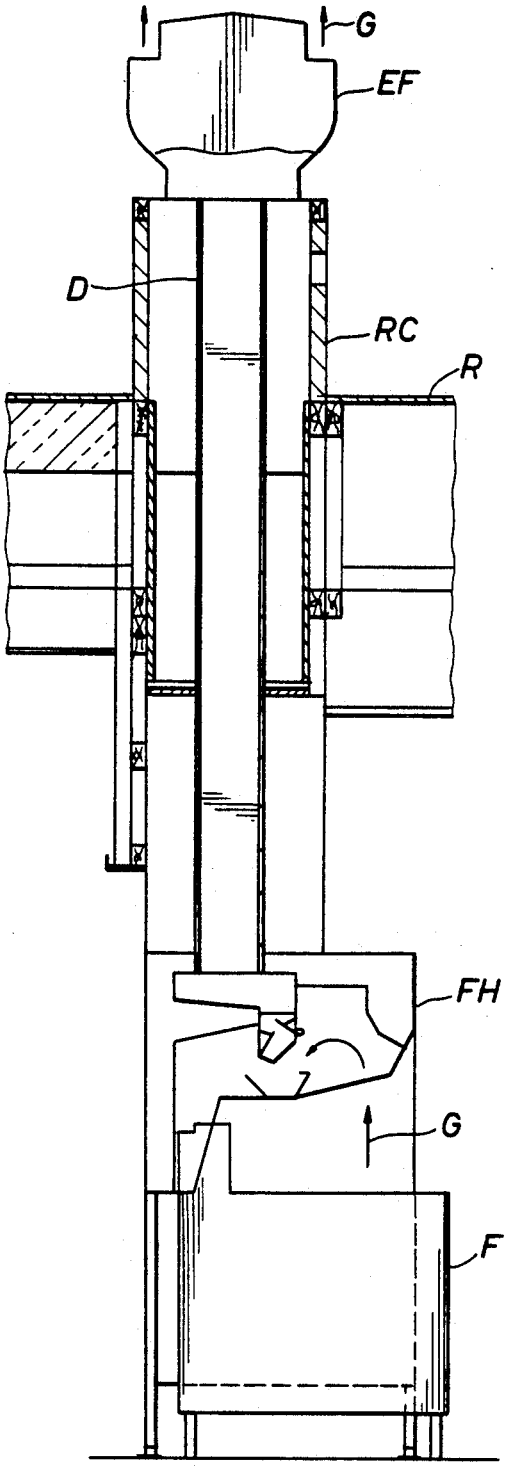
Figure 1B:
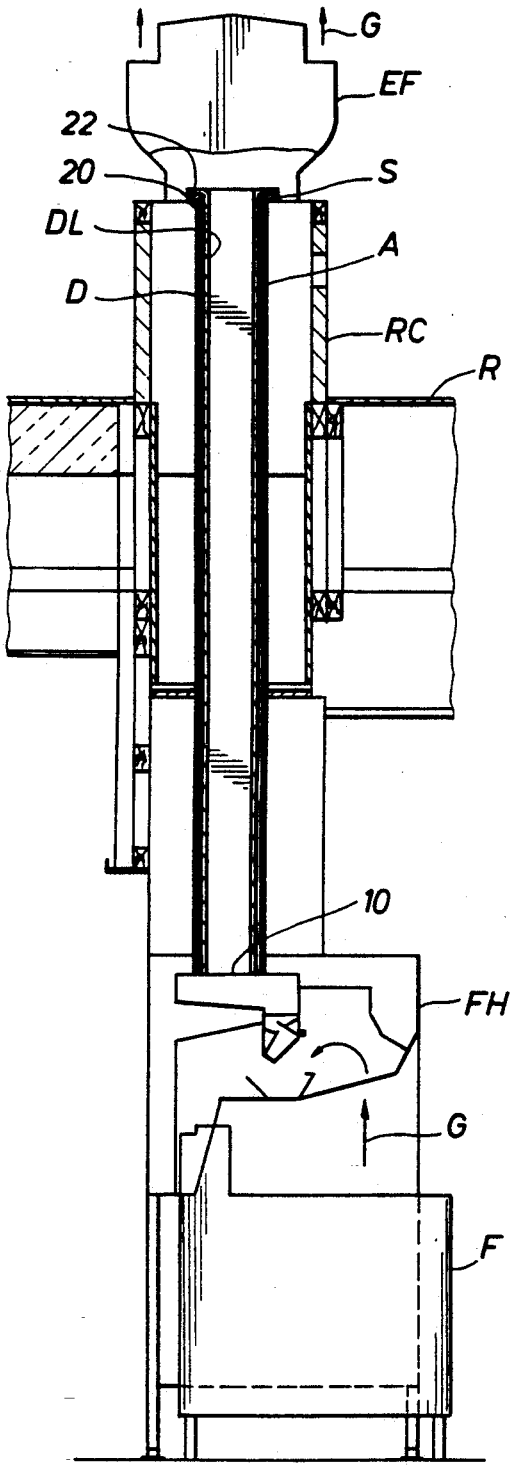

FIG. 1A illustrates a typical arrangement of a fryer F with fryer hood FH and duct D extending through the ceiling of a commercial kitchen to the roof R of the restaurant. The gas exhaust G passes from the fryer F through the hood FH and duct D and exhaust fan EF to the atmosphere. A rectangular duct D is illustrated. In FIG. 1B a rectangular duct liner DL, having seal S, is shown inserted in duct D.

Duct D is attached to the top portion of roof curb RC. Exhaust fan EF is also removably attached to the top of roof curb RC. FIG. 1C illustrates the duct system with exhaust fan EF removed. Duct liner DL of FIG. 1B hangs within duct D, also being supported by the top portion of the roof curb RC. Seal S is compressed between duct D and liner DL at the point of hanging.

Annular space A between duct liner DL and duct D, shown in FIGS. 1B and 1C is exaggerated in the drawing for purposes of illustration. According to the preferred embodiment, duct liner DL is custom built to closely fit, but not tightly fit, duct D from the cooking hood opening 10 in the cooking hood FH to the exhaust end 20 in the roof curb RC. The process of venting is maximized when the inside diameter of liner DL is as large as possible.

FIGS. 2 and 3 illustrate a round and rectangular duct liner DL, respectively, each having seal S affixed to the under side of lip 22 at the top, or exhaust end, of the liner. Seal S seals between the liner and the top or exhaust end of duct D, permitting no air or gas to escape. Thus, all gasses G containing oil and grease vent through fire hood FH into hood duct opening 10 and up the inside of duct liner DL. The gas is not permitted to escape through annular space A. Ambient air inhibits the circulation of gasses there.

To maintain duct D free of grease, the maintenance operator stands on roof R and first removes exhaust fan EF from over top exhaust opening 20 of duct D. The operator then lifts out custom built duct liner DL and, in the preferred embodiment, inserts a second clean custom built liner. In the preferred embodiment the grease laden duct liner DL is returned to the maintenance operator's shop to be thoroughly cleaned and stored until the next maintenance operation. Alternately, but less preferredly, the grease laden duct liner that was removed could be cleaned at the operator's truck and installed again in the duct.

It is believed that having two custom built duct liners for each establishment, and cleaning all grease laden duct liners at a central facility, is more efficient, cost effective and conducive to health and environment concerns.

Figure 4:
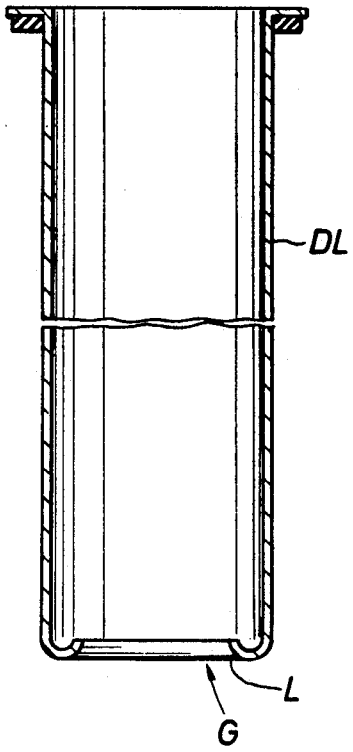
FIG. 4 offers a cross-sectional illustration of an alternate lower end of the duct liner.

FIG. 4 illustrates an additional detail of the present invention. Liner DL, at its lower end where the duct joins the vent hood duct opening, may contain an inner lip L. Inner lip L catches grease running or melting down the inside walls of liner L.

Figure 5A:
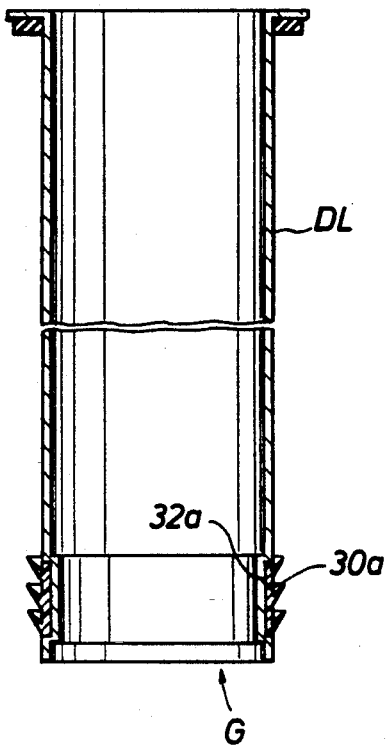
FIGS. 5A, 5B and 5C offer another cross-sectional illustration of alternate embodiments of the lower end of a duct liner.
Figure 5B:
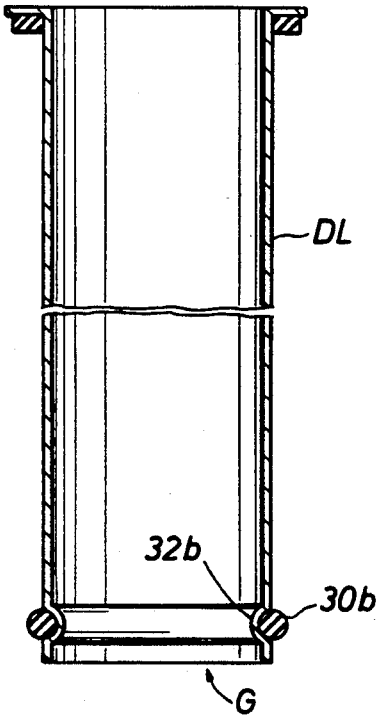
Figure 5C:
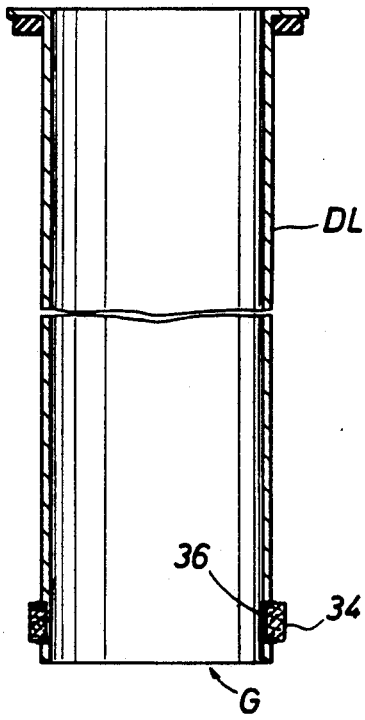

FIGS. 5A, 5B and 5C illustrate alternate details of the construction of a liner DL. In FIGS. 5A and 5B liner DL is shown with channel 32. Within channel 32 lies a sealer-wiper 30. Channel 32 is located near the end of the liner which will, when installed, lie adjacent the vent duct opening. Sealer-wiper 30 is shown in two alternate embodiments. One function of sealer-wiper 30 is to seal between liner DL and the duct D while the liner is installed. Thus, sealer-wiper 30 must be of a heat resistant material sufficient to withstand duct temperatures. A second function of sealer-wiper 30 is to wipe the walls of duct D when the grease laden liner is pulled from the duct out the exhaust end.

FIG. 5C illustrates a second channel 36 that is structured to receive temporary wiper 34. Channel 36, designed to receive wiper 34, is located near the end of liner DL adjacent the vent duct opening. Wiper 34 may be of felt, cloth, paper or any other highly absorbent material. In operation, absorbable wiper material 34 would be attached to liner DL shortly before pulling a grease laden liner out of duct D. It is anticipated that material 34 would not need to be of high heat resistant material.

The foregoing disclosure and description of the invention are illustrative and explanatory thereof. Various changes in the size, shape and materials as well as the details of the illustrated construction may be made without departing from the spirit of the invention.

What is claimed is:

1. A method for controlling grease build-up in cooking vent ducts, comprising prefabrication two liners each substantially comprised of a rigid tubular unit custom built to fit closely but not tightly within a duct and to define a small annular space between the duct and the liner;

installing one of the two liners in a duct between a cooking vent opening and the duct exhaust;

sealing providing a sealing member between said liner and said duct the annular space between the liner and the duct such that a majority of the space remains;

periodically replacing the installed liner with the other liner; and cleaning the replaced liner.

2. The method of claim 1 wherein the sealing member includes a high temperature seal.

3. The method of claim 1 that includes replacing the seal upon the cleaning of a liner.

4. The method of claim 1 including fitting a high temperature sealer-wiper closely between the duct and liner at the vent duct opening end of the duct.

5. The method of claim 4 that includes wiping the side of the duct as the installed liner is replaced.

6. The method of claim 1 that includes attaching an absorbent wiping material to the vent duct opening end of the liner prior to replacing the liner.

7. A method for controlling grease build-up in cooking vent ducts, comprising prefabricating a tubular liner substantially comprising a rigid unit custom built to fit closely but not tightly within a duct and to define a small annular space between the duct and the liner;

installing from the roof of a cooking premises the liner in a duct between a cooking vent opening and the duct exhaust;

providing a sealing member between said liner and said duct and sealing the annular space between the duct liner and the duct such that a majority of the annular space remains;

periodically removing the liner from the duct and from the roof;

cleaning the liner; and replacing the liner.

8. A duct liner for maintaining cooking vent ducts comprising a custom built preformed tube constructed of rigid material sufficient to withstand temperatures up to at least 350° F., located in a cooking vent duct and fashioned and dimensioned to fit closely but not tightly within said cooking vent duct between a duct cooking vent opening and an exhaust end, the liner having a seal at the exhaust end dimensioned to seal between the liner and the duct.

9. The liner of claim 8 that includes a high temperature sealer-wiper attached to the vent duct opening end of the liner.

* * * * *